US005384997A

United States Patent [19]

McClinton

[11] Patent Number: 5,384,997

[45] Date of Patent: Jan. 31, 1995

[54] COLUMN AND CORNER COMPOSITE, MOLD AND METHOD FOR PRODUCING GLAZED UNIT FOR SUCH

[75] Inventor: John McClinton, Hanover, Md.

[73] Assignee: The Burns & Russell Company, Baltimore, Md.

[21] Appl. No.: 884,200

[22] Filed: May 18, 1992

[51] Int. Cl.[6] ..... E04C 1/00

[52] U.S. Cl. ..... 52/596; 52/612; 52/259; 52/284; 52/609; 52/610; 404/41

[58] Field of Search ..... 52/596, 612, 259, 284, 52/309.13, 309.17, 596, 604, 605, 609, 610; 404/41, 42

[56] References Cited

U.S. PATENT DOCUMENTS

| | | | |
|---|---|---|---|
| 2,104,585 | 1/1938 | Dow et al. | 52/604 |
| 2,942,115 | 6/1960 | O'Connell | 52/604 |
| 3,632,725 | 1/1972 | Jones | 52/309.12 |
| 3,759,043 | 9/1973 | Tokunaga | 52/609 |
| 4,190,384 | 2/1980 | Neumann | 52/609 |
| 4,441,298 | 4/1984 | Limousin | 52/604 |
| 4,753,622 | 6/1988 | Nakama | 404/41 |
| 4,909,010 | 3/1990 | Gravier | 52/609 |
| 5,031,376 | 7/1991 | Bender et al. | 52/609 |
| 5,054,957 | 10/1991 | Johnson, II | 404/41 |
| 5,067,295 | 11/1991 | Francik et al. | 52/609 |
| 5,212,925 | 5/1993 | McClinton | 52/612 |

*Primary Examiner*—Carl D. Friedman
*Assistant Examiner*—Wynn E. Wood

[57] ABSTRACT

Glazed masonry building unit is provided for constructing a stanchion or turning a corner. The front face of each such masonry building unit is glazed with a resinous composition and is intended to be exposed. the front face comprises a planar portion, a first angled segment that intersects the planar portion at one end thereof to thereby form an obtuse angle, and a second angled segment that intersects the planar portion at the other end thereof to thereby form an obtuse angle. Also provided is a stanchion constructed of a plurality of the glazed masonry building units. Moreover, there is provided a mold for producing the glazed masonry building units.

34 Claims, 7 Drawing Sheets

COLUMN AND CORNER COMPOSITE, MOLD AND METHOD FOR PRODUCING GLAZED UNIT FOR SUCH

DESCRIPTION

1. Technical Field

The present invention is concerned with a glazed masonry building unit that can be used to turn a corner. In addition, according to the present invention a stanchion can be constructed employing a plurality of the glazed masonry building units. The present invention is also concerned with a mold for providing the glazed masonry building units employed to provide the constructions of the present invention.

2. Background Art

Filled polymeric materials have been known to provide decorative and protective surfaces to walls. For instance, it has been known to coat masonry units filled with polyesters and to form walls therefrom. The basic patent on the use of polyester as coatings for masonry units is U.S. Pat. No. 2,751,775 to Sergovic and assigned to the assignee of the present application. Over the years, a number of improvements in the coating compositions for the masonry building units have been developed. For instance, U.S. Pat. No. 3,328,231 to Sergovic and assigned to the assignee of the present application, discloses a glazed masonry building block made of a cured composition of an unsaturated polyester resin and sand in which the sand comprises at least 50% by weight of the coating composition. The unsaturated polyester is derived from a reaction between a dicarboxylic acid, such as phthalic, maleic, fumaric, adipic, pimelic, suberic, itaconic, citraconic, succinic acids, and/or an anhydride thereof, and a polyhydric alcohol such as ethylene glycol, diethylene glycol, and propylene glycol. Also present in such compositions is an unsaturated monomer, such as methyl methacrylate, styrene, diallyl phthalate, t-butyl styrene,and alphamethyl styrene. Furthermore, U.S. Pat. No. 4,031,289 to Sergovic discloses coated masonry building blocks, articles and compositions therefore that employ various pigments and chemicals in combination with various resinous compositions to provide stain resistance when subjected to high moisture conditions and/or staining media. The disclosures of the above mentioned U.S. Pat. Nos. 2,751,775, 3,328,231 and 4,031,289 as well as U.S. Pat. Nos. 4,329,822 and 2,817,619 are incorporated herein by reference.

Unfinished columns or pillars are unsightly and undesirable from an aesthetic point of view. Accordingly, there have been various techniques employed to provide a finished look to columns and pillars including some use of a plurality of glazed 90° masonry corner units forming a rectangular configuration. However, the use of such is not especially desirable in view of the rather sharp corners that are formed. These corners are particularly susceptible to damage such as chipping. These prior art corners are typically between ⅛ inch radius to 1 inch radius with the ⅛ inch radius being referred to as JP and the 1 inch radius being referred to as JO. The head joints of such are difficult to keep straight and are not always aesthetically pleasing.

SUMMARY OF INVENTION

The present invention provides glazed masonry units that are suitable for creating a turn such as turning a corner or constructing a partial or complete 360° stanchion. The present invention provides an architecturally aesthetic construction that is self-supporting and load bearing.

The glazed raw block masonry building units of the present invention include a front face, a back face, a top face, a bottom face and two side faces. To form the glazed masonry unit, the front face is glazed with a resinous composition and is intended to be exposed and includes a planar surface that is opposite the back face and preferably extends parallel to the back face (raw block) and a second glazed surface that intersects the planar portion at one end thereof to thereby form an obtuse angle, and a second angled glazed surface that intersects the planar portion at the other end thereof to thereby form an obtuse angle. The length of each angled glazed surface is generally about one-half the length of the planar portion of the front face. Each of the two side faces of the masonry building is angled and intersects a respective one of the first or second angled glazed surfaces of the front face and also intersects the back face. The side faces form an obtuse angle or right angle with the back face. Each of the side faces forms a right angle or an obtuse angle or an acute angle with a respective one of the first or second angled glazed surface of the front face.

The reference to the location of the faces of the masonry unit such as front, back, top, bottom and side is used herein to denote the relationship of the various faces to each other but is not intended to denote the orientation of the unit in a particular building construction.

Another aspect of the present invention is concerned with a composite of at least two of the above described glazed angled concrete block masonry building units.

A still further aspect of the present invention is concerned with a mold that is suitable for the fabrication of glazed masonry building units. In particular, the mold includes a bottom portion having a horizontal planar segment and two angled segments, wherein each angled segment intersects the horizontal planar segment at one end thereof to form an obtuse angle. The mold also includes sidewalls and at least one flange located an end of the mold.

BEST AND VARIOUS MODES FOR CARRYING OUT INVENTION

Figure 1:
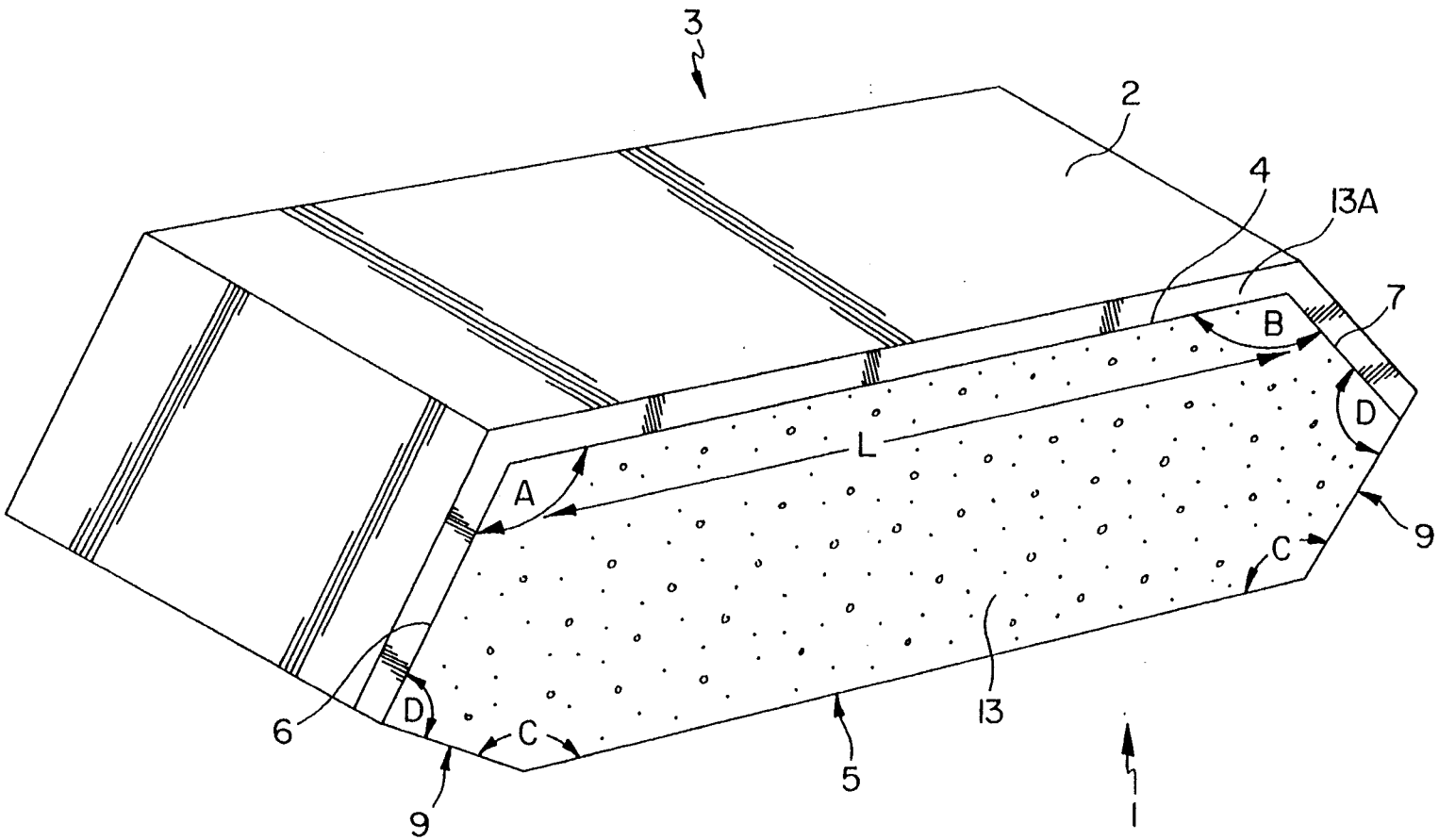
FIG. 1 is an isometric view of a glazed masonry unit pursuant to the present invention.

In order to facilitate an understanding of the present invention, reference is made to the figures. In particular, FIG. 1 is an isometric view of a glazed masonry unit pursuant to the present invention that includes a glaze 2 on the front face 3 of the masonry block 1. Examples of suitable glaze compositions are based upon the unsaturated polyester resin compositions disclosed in U.S. Pat. Nos. 2,751,775, 3,328,231, 3,632,725, 4,031,289, and 4,329,822, the entire disclosures of which are hereby incorporated by reference and relied upon. The masonry block 1 can be made from those materials employed to produce masonry block such as cinders, slag, haydite, expanded clay, or shale, or the like together with cement. This glazed front face of the masonry block is that face which is intended to be exposed to the environment in which the block is employed in a building application. The front face of the masonry block includes a planar portion 4 that is opposite to and preferably extends parallel to a back face 5.

The front face also includes a first angled segment 6 that intersects the planar portion 4 at an obtuse angle A depending upon the desired angle of the turn at that end of the block. In a preferred aspect according to the present invention, angle A is about 135°. The front face also includes a second angled segment 7 that intersects the planar portion 4 at an obtuse angle B depending upon the desired angle of the turn at that end of the block.

Preferably angle B is the same as angle A and in a preferred aspect according to the present invention, angle is about 135°.

Each angled segment (6 and 7) of front face 3 is about one-half the length of "L" of the planar portion 4 of the front face 3.

For example, to construct a complete column (360°) about 16 inches in diameter employing 4 glazed units, the length of each angled segment is about 3¼ to about 3¾ inches, and the length illustrated in FIG. 1 as L is about 7¾ inches.

Each side face 9 is angled and intersects the back face 5 and a respective one of the first angled segment 6 and second angled segment 7 of the front face 3. Each side face 9 forms an obtuse angle C with the back face 5, and in preferred aspect of the present invention, angle C is about 135°.

In addition, each side face 9 forms an angle D with a respective one of angle segments 6 and 7 of front face 3. The angle D can be either a right angle, or an acute angle or an obtuse angle, and preferably is a right angle. In any event, the respective angles D of adjacent blocks are such that their sum will be about 180°.

In addition, in a preferred aspect of the present invention, a minor portion 13A of top face 13 (see FIG. 1) is also glazed with the glazing composition. Typically this glazed portion 13A is about ½ inch to about 1 inch regardless of the width of the top face. The bottom face (not shown) is opposite the top face and preferably parallel to the top face as in conventional masonry units.

If desired, a cut out portion (see FIG. 7) can be provided in one or both of the side faces. The cut out portion makes it possible to provide reinforcement at the junction of the unit with another masonry unit by providing space for pouring concrete or by providing the space for the insertion of a reinforcing member segment of an adjoining masonry unit.

The cut out portion merely needs to be large enough to provide the desired additional strength with the maximum size being primarily limited by merely assuring the integrity of the block during handling and construction and by economics. In addition, the location of the cut out portion is typically such that the length of the side wall adjacent to each end of the cut out portion is at least about 1½ inches and preferably at least about 1.625 inches to insure against a portion of the block breaking off during handling and construction. The specific shape and dimensions for the cut out portion and location for a particular embodiment can be determined by those skilled in the art once aware of this disclosure without undue experimentation.

Figure 7:
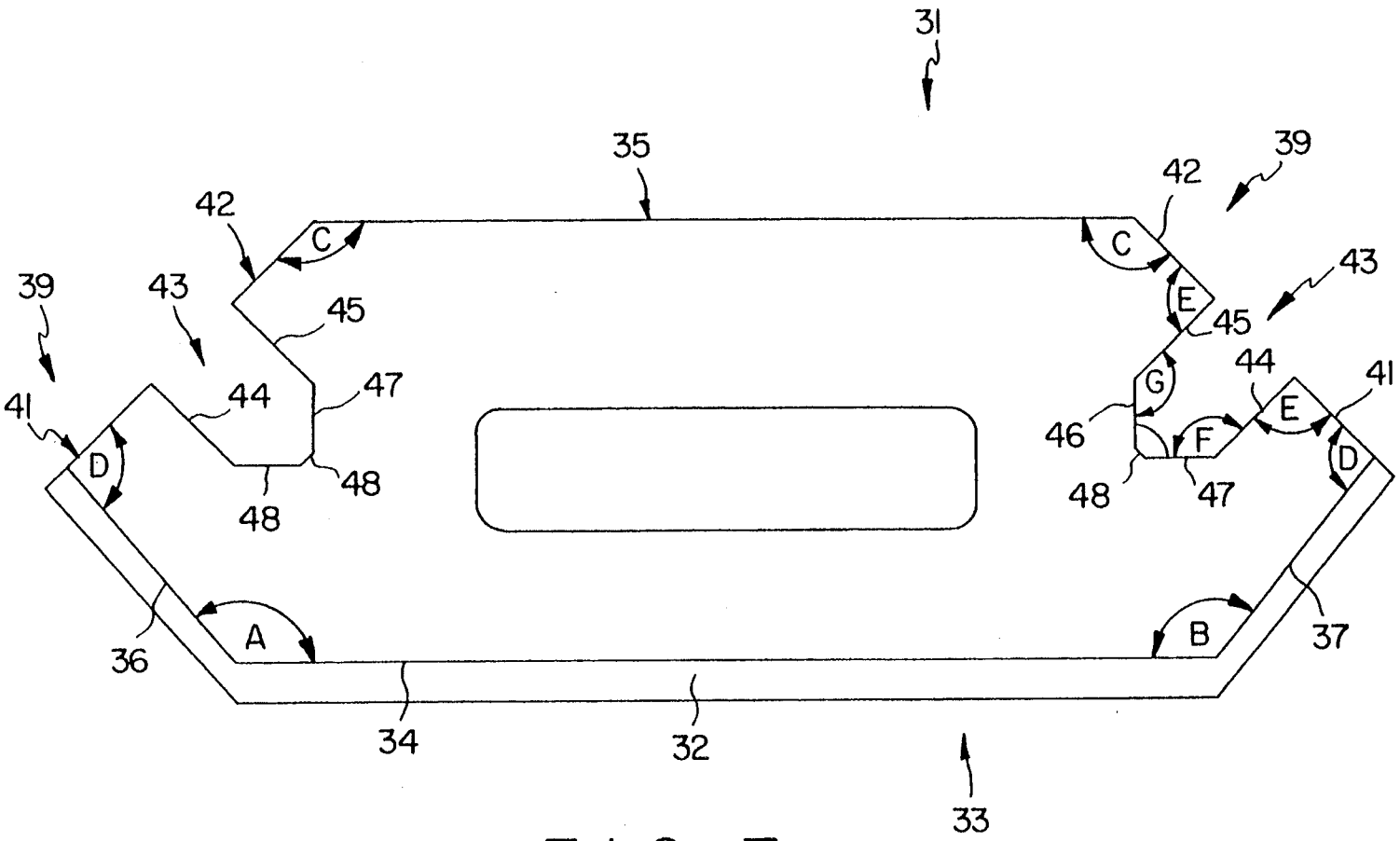
FIG. 7 is a top elevational view of an alternative embodiment of a glazed masonry unit of the present invention.

FIG. 7 is a top elevational view of a glazed masonry building unit which includes a glaze 32 on the front face 33 of the masonry block 31.

The front face of the masonry block includes a planar portion 34 that is opposite to and preferably extends parallel to a back face 35. The front face also includes a second segment 36 that intersects the planar portion 34 at an obtuse angle A depending upon the angle of the turn at that end of the block. In a preferred aspect according to the present invention, angle A is about 135°. The front face also includes a second angled segment 37 that intersects the planar portion 34 at an obtuse angle B depending upon the desired angle of the turn at that end of the block.

Preferably angle B is the same as angle A and in a preferred aspect according to the present invention, angle is about 135°.

Each angled segment (36 and 37) of front face 33 is about one-half the length of the planar portion 34 of the front face 33.

Each side face 39 is angled and intersects the back face 35 and a respective one of the first angled segment 36 and second angled segment 37 of the front face 33. Each side face 39 forms an obtuse angle C with the back face 35, and in preferred aspect of the present invention, angle C is about 135°.

In addition, each side face 39 forms an angle D with a respective one of angle segments 36 and 37 of front face 33. The angle D can be either a right angle, or an acute angle or an obtuse angle, and preferably is a right angle. In any event, the respective angles D of adjacent blocks are such that their sum will be about 180°.

Side face 39 includes segments 41 and 42 with cut out portion 43 located therebetween. Cut out portion 43 includes opposing side walls 44 and 45. Side walls 44 and 45 intersect segments 41 and 42, respectively, at an angle E which is preferably but not necessarily a 90° angle. Also side walls 44 and 45 intersect side walls 46 and 47, respectively at angles F and G, respectively. Angles F and G in this embodiment are each about 135°. Walls 46 and 47 converge forming a rounded portion 48.

Additional cut out portions suitable for the present invention include those disclosed in FIGS. 7–11 in my copending U.S. application Ser. No. 07/919,988, filed Jul. 27, 1992 and entitled "Wall Corner Composite, Mold and Method for Producing Glazed Unit for Such," which in turn is a continuation-in-part of my copending U.S. application 07/795,773 filed Nov. 21, 1991 and entitled "Wall Corner Composite, Mold and Method for Producing Glazed Unit for Such," entire disclosures of which are incorporated herein by reference.

Furthermore, if desired, such can include means (not shown) for receiving horizontally placed reinforcement rods (not shown) that will be held in place when cement is poured into the cut out portion. The receiving means include valleys 175 provided at the ends of the web of the block as illustrated in FIG. 14 of by copending application 07/919,988 filed Jul. 27, 1992, referred to above. Masonry units containing such rods are suitable for use in earthquake construction.

Although, FIG. 7 shows cut out portions in both side walls, it is understood that it may be desirable to provide a glazed masonry building unit wherein only one of the side walls has a cut out portion.

Figure 3:
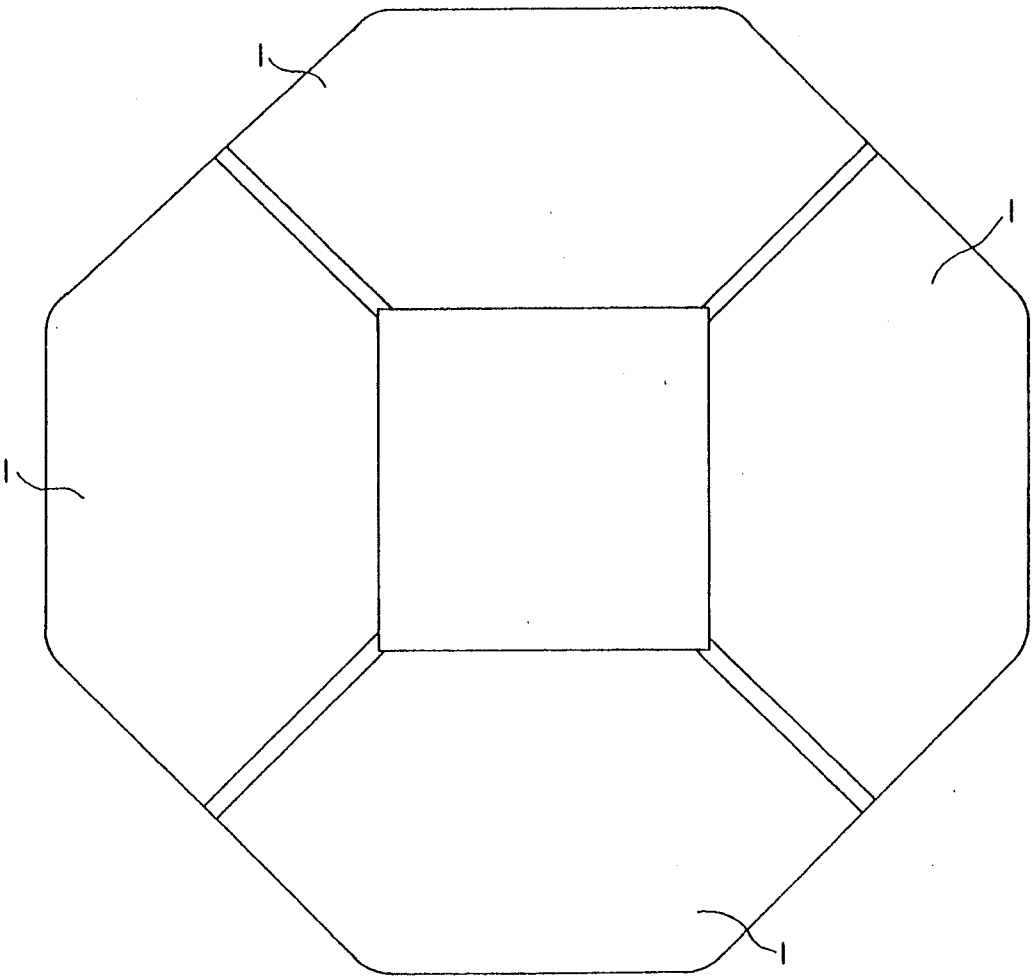
FIG. 3 is top elevational view of a section of a stanchion pursuant to the present invention.
Figure 4:
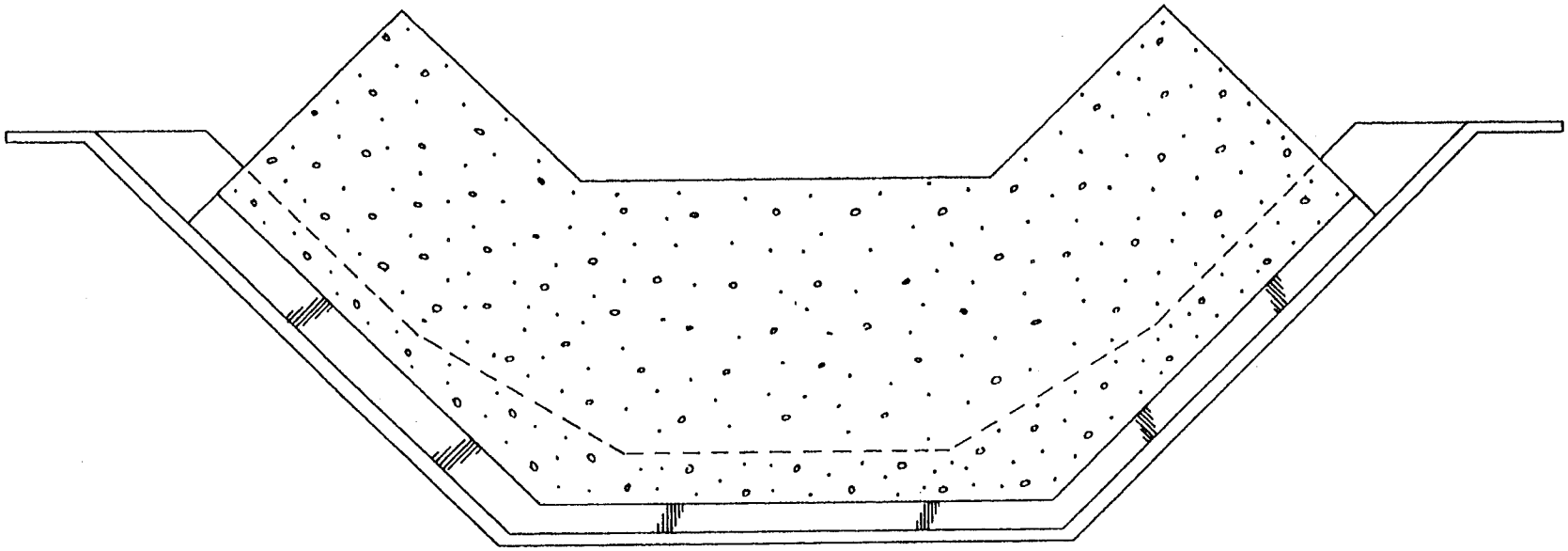
FIG. 4 is a side view of the mold containing the glazing composition and a masonry unit.
Figure 5:
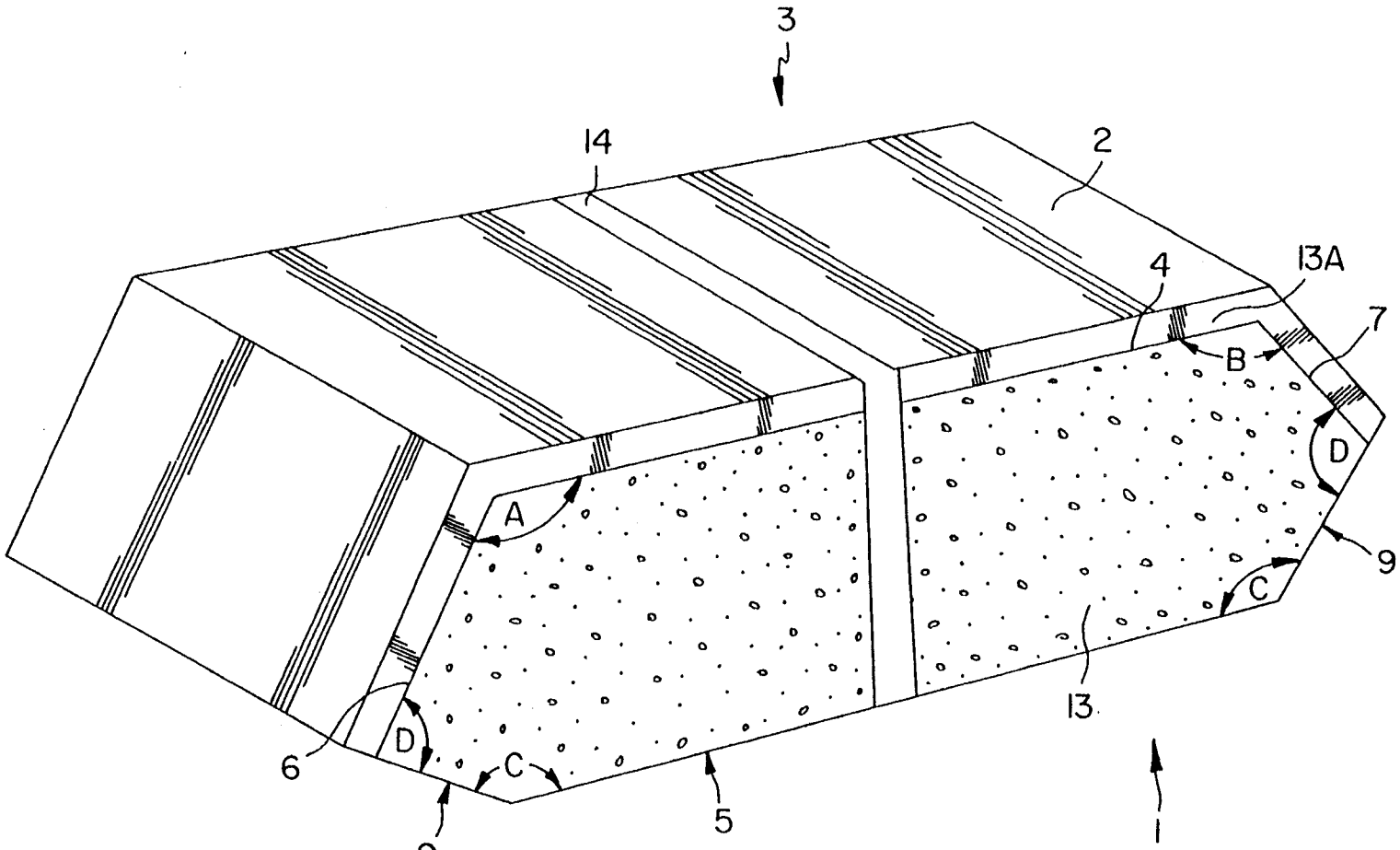
FIGS. 5 and 6 are isometric views of alternative embodiments of glazed masonry units of the present invention.

The individual masonry building units of the present invention are preferably single unitary units but can be composed of a plurality of component parts to be bonded together by mortar 14, if desired. For example, masonry building units of the present invention have been constructed from two equal parts as shown in FIG. 5. Reference to FIG. 3 shows a segment of a stanchion including mating pairs of coated masonry blocks 1 of the present invention.

Figure 6:
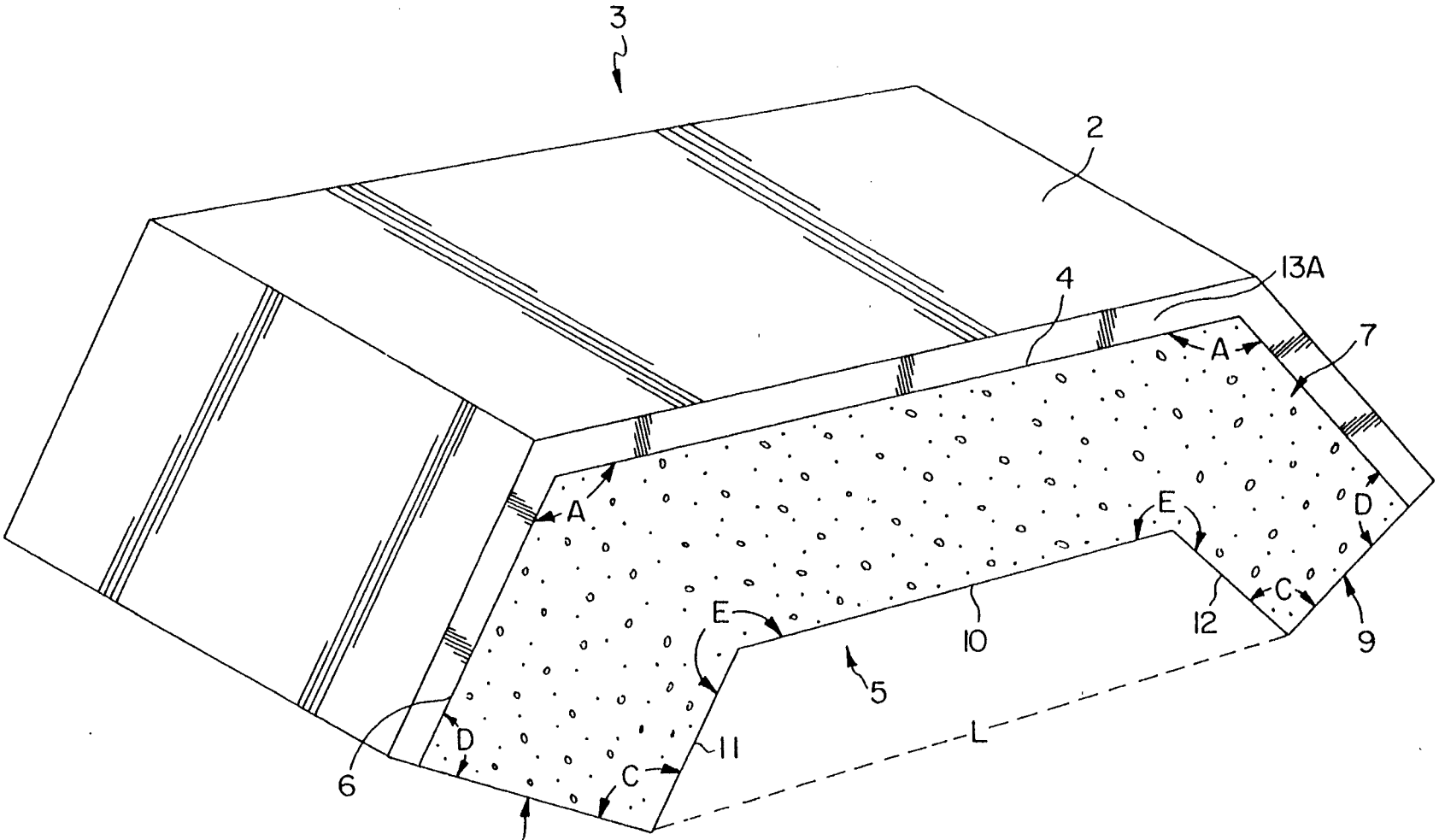

FIG. 6 illustrates a further embodiment of the glazed masonry building units of the present invention. In particular, FIG. 6 is an isometric view of a glazed masonry unit pursuant to the present invention that includes a glaze 2 on the front face of 3 of the masonry block 1.

The front face of the masonry block includes a planar portion 4 that is opposite to and preferably extends parallel to a back face 5. The front face also includes a first angled segment 6 that intersects the planar portion 4 at an obtuse angle A depending upon the desired angle of the turn at that end of the block. In a preferred aspect according to the present invention, angle A is about 135°. The front face also includes a second angled segment 7 that intersects the planar portion 4 at an obtuse angle B depending upon the desired angle of the turn at that end of the block.

Preferably angle B is the same as angle A and in a preferred aspect according to the present invention, angle is about 135°.

Each angled segment (6 and 7) of front face 3 is about one-half the length of "L" of the planar portion 4 of the front face 3.

For example, to construct a complete column (360°) about 16 inches in diameter employing 4 glazed units, the length of each angled segment is about $3\frac{1}{4}$ to about $3\frac{3}{4}$ inches, and the length illustrated in FIG. 6 as L is about $7\frac{3}{4}$ inches.

Each side face 9 is angled and intersects the back face 5 and a respective one of the first angled segment 6 and second angled segment 7 of the front face 3. Each side face 9 forms an obtuse angle or right angle C with the back face 5, and in a preferred aspect of the present invention, angle C is a right angle.

In addition, each side face 9 forms an angle D with a respective one of angle segments 6 and 7 of front face 3. The angle D can be either a right angle, or an acute angle or an obtuse angle, and preferably is a right angle. In any event, the respective angles D of adjacent blocks are such that their sum will be about 180°.

According to preferred aspects of the present invention, back face 5 is parallel to front face 3 and includes a substantially corresponding planar portion 10, a first angled segment 11 and a second angled segment 12. The angled segments form obtuse angles and preferably angles of 225°.

In addition, in a preferred aspect of the present invention, a minor portion 13A of top face 13 (see FIG. 1) is also glazed with the glazing composition. Typically this glazed portion 13A is about $\frac{1}{2}$ inch to about 1 inch regardless of the width of the top face. The bottom face (not shown) is opposite the top face and preferably parallel to the top face as in conventional masonry units.

Figure 2:
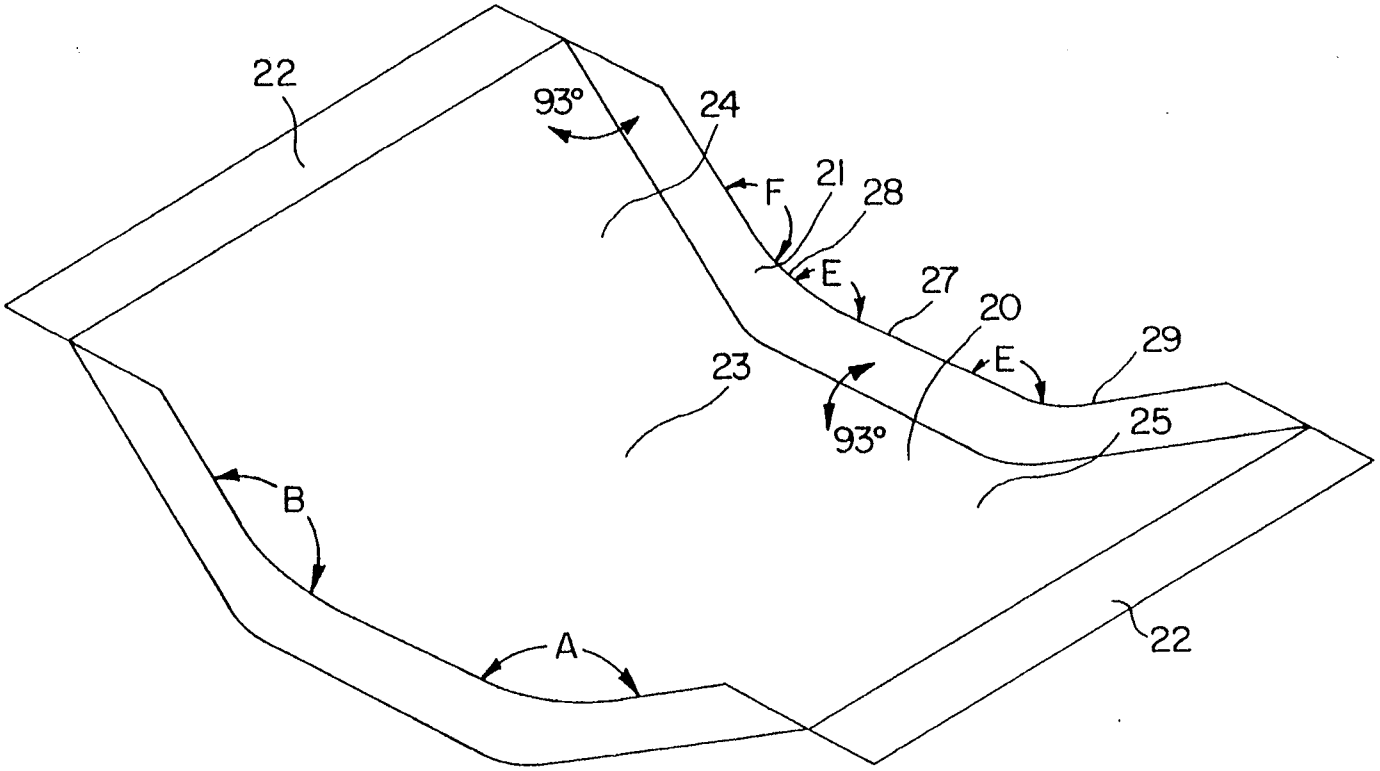
FIG. 2 is an isometric view of a mold suitable for obtaining the glazed masonry unit pursuant to the present invention.

FIG. 2 illustrates a mold that can be employed for glazing the masonry blocks pursuant to the present invention. In particular, the mold includes a pan or a bottom portion 20, sidewalls 21, and flange members 22.

Bottom portion 20 includes a horizontal planar segment 23 at an angle (e.g. 135°) corresponding respectively to angle A and B of the masonry block to be glazed.

The flange members 22 provide a location where pressure can be applied to the mold for removal of the glazed block upon completion of the processing. The flange typically extends out from the mold from about $\frac{1}{4}''$ to about $1\frac{1}{2}''$ and more typically about 1". For ease of manufacture, the flange is typically the same width as is the mold but can be less or more if desired.

In a typical arrangement, the top portion of the side wall for the purpose of ease of fabrication includes a planar portion 27 and angled segments 28 and 29 that intersect the planar portion to form an obtuse angel E, which is more typically about 150°. Also, the angle portion includes a bend forming an obtuse angle F, which is more typically about 150°. This bend is typically located at about 40% to about 50% of the total rise of the angled segment as measured from the horizontal. In a typical mold for producing an 8 inch block of the present invention, the local horizontal use of each angled segment is about 3.875 inches and the bend occurs at a rise of about 1.75 inches.

The mold employed as apparent to those skilled in the art will be somewhat larger than the block to be glazed in order to accommodate the glaze composition. For a mold to coat a block having an eight (8) inch high nominal front face, the width of the mold will be about $7\frac{3}{4}$ inches, the side walls will be about $\frac{1}{2}$ inch to about 1 inch, the angle walls will be about 5.66 inches. The side walls are substantially perpendicular to the bottom portion and typically at about a 93° angle.

In use, the desired glaze composition is applied to the horizontal portion 23 of the mold to the desired thickness less than the height of the walls 12. Typical glaze thicknesses on face 6 are about $\frac{1}{8}''$ to about $\frac{3}{4}''$ and on face 2 are about $\frac{1}{8}''$ to about $\frac{3}{4}''$. Also typical compositions are in the form of relatively viscous slurries having a ratio of filler to liquid of about 2.5:1 to about 7:1 and more typically about 4.0:1 to about 5.5:1. The glaze composition can be uniformly distributed over the horizontal bottom surface of the mold by employing a mechanical device such as a shaker and vibrator as known in the art. Next the shaped block is placed in the mold. The block can either be premolded to the desired shape or can be cut from a standard rectangular shaped block.

According to preferred aspects of the present invention, aggregate, typically sand, is then placed around the edges of the block between the inside of side walls 21 and the block, and filled to the top of mold. The aggregate typically has a particle size of about 30 to about 150 mesh. The aggregate is wetted by a wicking action from the slurry and facilitates glazing of the block.

After this, putty such as that commercially available, clay, or more commonly modelling clay, can be securely placed between the block and the edge of the mold along the side wall of the angled portion of the mold. The glazing composition is then poured into the cavity remaining between the block and mold along the inside of the angled portion of the mold for glazing of the angled segment of the block. The putty or clay helps in conjunction with the block to maintain the slurry in place for glazing of the block, while filling and going through the cure cycle.

After this, the glazing composition is cured. The curing can be carried out at room temperature, if desired, depending upon the specific composition selected. Preferably, it is carried out at an elevated temperature of about 150° F. to about 450° F. and more preferably at about 280° F. to about 320° F. Typically, the temperature of the coating is raised to these levels in about 10–30 minutes and held there for sufficient time such as 2–5 minutes to complete polymerization.

An advantage of the present invention is that the entire glazing can be cured in less time as compared to glazing two adjacent sides of a standard shaped masonry unit.

After the glaze is properly cured, the glazed masonry unit is removed from the mold by turning the mold with the unit therein over and by applying pressure at the flange of the mold to thereby lift off the mold and release the glazed product.

While the present invention has been described with respect to various preferred aspects thereof, it will be appreciated that the present invention can be implemented in a number of different ways by those skilled in the art once aware of the present disclosure to suit particular requirements. It will be understood that various changes and substitutions may be made within the spirit and scope of the invention as defined in the following claims.

What is claimed is:

1. A glazed angled masonry building unit comprising a front face, a back face, a top face, a bottom face and two side faces wherein said front face is glazed with a resinous composition and is intended to be exposed and comprises a planar portion that is opposite to said back face; a first angled segment that intersects said planar portion at one end thereof to thereby form an obtuse angle, and a second segment that intersects said planar portion at the other end thereof to thereby form an obtuse angle; each of the two side faces being angled and intersecting a respective one of said first angled segment and said second angled segment to form a right, acute or obtuse angle therewith, and intersecting said back face to form an obtuse angle or right angle with said back face.

2. The glazed masonry building unit of claim 1 wherein the obtuse angles formed by the intersecting of said first angled segment and said second angled segment with said planar portion are equal.

3. The glazed masonry building unit of claim 2 wherein said obtuse angles are about 135°.

4. The glazed masonry building unit of claim 1 wherein each angled segment is about one-half the length of said planar portion of front face.

5. The glazed masonry building unit of claim 1 wherein each angled segment is about $3\frac{1}{4}$ to about $3\frac{3}{4}$ inches in length.

6. The glazed masonry building unit of claim 1 wherein the angle at the intersection of each side face with the respective one of said first angled segment and said second angled segment is about 90°.

7. The glazed masonry building unit of claim 1 wherein each side face forms a 135° angle with the back face.

8. The glazed masonry building unit of claim 1 wherein said back face comprises a planar portion, a first angled segment that intersects said planar portion at one end thereof to thereby form an obtuse angle, and a second angled segment that intersects said planar portion at the other end thereof to thereby form an obtuse angle.

9. The glazed masonry building unit of claim 8 wherein the obtuse angles are about 135°.

10. The glazed masonry building unit of claim 1 wherein a minor portion of the top face or bottom face or both is glazed.

11. The glazed masonry building unit of claim 10 wherein said minor portion is about $\frac{1}{2}$ inch to about 1 inch.

12. The glazed masonry building unit of claim 1 wherein each glazed masonry building unit is a single unitary block.

13. The glazed masonry building unit of claim 1 wherein each glazed masonry building unit comprises two equal parts.

14. A composite comprising at least two glazed masonry building units each having two angled return end portions and two angled side faces wherein an angled side face of one glazed masonry building unit faces an angled side face of another glazed masonry building unit; and wherein each glazed masonry building unit comprises a front face, a back face, a top face, a bottom face and two side faces wherein said front face is glazed with a resinous composition and is intended to be exposed and comprises a planar portion that is opposite to said back face; a first angled segment that intersects said planar portion at one end thereof to thereby form an obtuse angle, and a second segment that intersects said planar portion at the other end thereof to thereby form an obtuse angle; each of the two side faces being angled and intersecting a respective one of said first angled segment and said second angled segment to form a right, acute or obtuse angle therewith, and intersecting said back face to form an obtuse angle or right angle with said back face.

15. The composite of claim 14 wherein the obtuse angles formed by the intersecting of said first angled segment and said second angled segment with said planar portion are equal.

16. The composite of claim 15 wherein said obtuse angles are about 135°.

17. The composite of claim 14 wherein each angled segment is about one-half the length of said planar portion of said front face.

18. The composite of claim 14 wherein each angled segment is about $3\frac{1}{4}$ to about $3\frac{3}{4}$ inches in length.

19. The composite of claim 14 wherein the angle at the intersection of each side-face with the respective one of said first angled segment and said second angled segment is about 90°.

20. The composite of claim 14 wherein the sum of respective angles at the intersection of the side faces of adjacent building units is about 180°.

21. The composite of claim 14 wherein each side face forms a 135° angle with the back face.

22. The composite of claim 14 wherein said back face comprises a planar portion, a first angled segment that intersects said planar portion at one end thereof to thereby form an obtuse angle, and a second angled segment that intersects said planar portion at the other end thereof to thereby form an obtuse angle.

23. A composite of claim 22 wherein the obtuse angles are about 135°.

24. The composite of claim 14 wherein a minor portion of the top face or bottom face or both is glazed.

25. The composite of claim 24 wherein said minor portion is about ½ inch to about 1 inch.

26. The composite of claim 14 wherein each glazed masonry building unit is a single unitary block.

27. The composite of claim 14 wherein each glazed masonry building unit comprises two equal parts.

28. The composite of claim 14 being in the shape of a stanchion.

29. The composite of claim 28 wherein said stanchion is a complete 360° column.

30. The composite of claim 29 which comprises four masonry building units per layer to provide the 360° column.

31. The glazed masonry building unit of claim 1 wherein at least one of said sides includes a cut out portion interposed between said front face and said back face.

32. The glazed masonry building unit of claim 1 wherein both of said side faces includes a cut portion interposed between said front face and said back face.

33. The glazed masonry building unit of claim 32 wherein the length of the side wall adjacent to each end of the cut out portions is at least about 1½ inches.

34. The glazed masonry building unit of claim 31 wherein the length of the side wall adjacent to each end of the cut out portions is at least about 1½ inches.

* * * * *